US009196225B2

(12) United States Patent
Kanda et al.

(10) Patent No.: US 9,196,225 B2
(45) Date of Patent: Nov. 24, 2015

(54) ELECTRO-OPTIC DEVICE AND DRIVING METHOD THEREOF

(71) Applicant: SAMSUNG DISPLAY CO., LTD., Yongin, Gyeonggi-Do (KR)

(72) Inventors: Eiji Kanda, Yokohama (JP); Masayuki Kumeta, Yokohama (JP); Ryo Ishii, Yokohama (JP); Takeshi Okuno, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 32 days.

(21) Appl. No.: 14/095,469

(22) Filed: Dec. 3, 2013

(65) Prior Publication Data

US 2015/0154941 A1 Jun. 4, 2015

(51) Int. Cl.
*G09G 5/18* (2006.01)
*G09G 3/32* (2006.01)

(52) U.S. Cl.
CPC ..... *G09G 5/18* (2013.01); *G09G 3/3258* (2013.01)

(58) Field of Classification Search
CPC ..... G09G 5/18; G09G 3/3258
See application file for complete search history.

(56) References Cited

U.S. PATENT DOCUMENTS

2006/0232218 A1* 10/2006 Osame et al. ..... 315/169.3

FOREIGN PATENT DOCUMENTS

| | | | |
|---|---|---|---|
| JP | 2003-271095 | A | 9/2003 |
| JP | 2004-314200 | A | 12/2004 |
| JP | 2005-031630 | A | 2/2005 |
| JP | 2005-316380 | A | 11/2005 |
| JP | 2009-258227 | A | 11/2009 |
| JP | 2010-039117 | A | 2/2010 |
| JP | 2010-224390 | A | 10/2010 |
| JP | 2011-154097 | A | 8/2011 |

* cited by examiner

*Primary Examiner* — Liliana Cerullo
(74) *Attorney, Agent, or Firm* — Lee & Morse, P.C.

(57) ABSTRACT

A driving method of an electro-optic device includes initializing a gate voltage of a driving transistor; and performing a data write operation where a threshold voltage of the driving transistor is compensated by turning on a first transistor and a second transistor connected in series between a drain and a gate of the driving transistor and a voltage is provided to a capacity element connected to the gate of the driving transistor to hold a voltage of the compensated data signal as a gate voltage. The first transistor is at a drain side of the driving transistor and the second transistor is between the first transistor and a gate side of the driving transistor. When the data write operation ends, the second transistor is first turned off and, subsequently, the first transistor is turned off. The second transistor is again turned on after the first transistor is turned off.

8 Claims, 14 Drawing Sheets

ELECTRO-OPTIC DEVICE AND DRIVING METHOD THEREOF

CROSS-REFERENCE TO RELATED APPLICATION

Japanese Patent Application No. 2012-264176, filed on Dec. 3, 2012, in the Korean Intellectual Property Office, and entitled: "Electro-Optic Device and Driving Method Thereof," is incorporated by reference herein in its entirety.

BACKGROUND

1. Field

Embodiments relate to an electro-optic device and method of driving thereof using a current emission element that emits light according to a current.

2. Description of the Related Art

An electro-optic device (e.g., an organic electroluminescence (hereinafter, referred to as an organic EL)) may include an element (hereinafter, referred to as a current light-emitting element) that emits light based on the intensity corresponding to a supplied current. The electro-optic device controls a gradation of a display image by controlling the amount of current supplied to the current light-emitting element using a driving transistor of each pixel. Therefore, if characteristics of driving transistors are different from one another, such a characteristic difference directly influences a display image. In particular, in a pixel circuit where a current flowing to the current light-emitting element is controlled by supplying a signal having a voltage level according to a gradation to a gate of the driving transistor, a threshold voltage of the driving transistor is changed, so that a gradation of a display image may be uneven.

SUMMARY

One or more embodiments is directed to providing a driving method of an electro-optic device which comprises initializing a gate voltage of a driving transistor; performing a data write operation where when a data signal having a voltage level corresponding to a gradation is provided to the driving transistor a threshold voltage of the driving transistor is compensated by turning on a first transistor and a second transistor connected in series between a drain and a gate of the driving transistor and a voltage is provided to a capacity element connected to the gate of the driving transistor to hold a voltage of the compensated data signal as a gate voltage, the first transistor being placed at a drain side of the driving transistor and the second transistor being placed at a gate side of the driving transistor; and performing a light-emitting operation where a light is emitted by providing a drain current according to the held gate voltage of the driving transistor to a current light-emitting element connected to the drain of the driving transistor, wherein when the data write operation is ended, the second transistor of the first and second transistors being at a turn-on state is first turned off and the first transistor is then turned off; and wherein the second transistor is again turned on after the first transistor is turned off.

The data signal may be provided to a source of the driving transistor.

The first transistor and at least one third transistor may be connected in series between the first transistor and the second transistor is at a turn-on state during the data write operation and is at a turn-off state during the light-emitting operation.

When the data write operation is ended, the second transistor of the first and second transistors being at a turn-on state may be first turned off, a light-emitting control transistor connected between the drain of the driving transistor and the current light-emitting element may then be turned on, and afterwards the first transistor may be turned off. After the first transistor is turned off, the second transistor may again be turned on.

A voltage may be provided to a gate of the second transistor such that a gate-drain voltage when the second transistor is turned on at the light-emitting operation is higher than a gate-drain voltage when the second transistor is turned on at the data write operation, to compensate for the threshold voltage of the driving transistor.

One or more embodiments is directed to providing an electro-optic device that includes pixels arranged in a matrix, data signal lines configured to transfer data signals having voltage levels corresponding to a gradation to the pixel circuits; and first and second gate signal lines configured to control the pixel circuits. Each pixel includes a pixel circuit connected to a light-emitting element. The pixel circuit includes a driving transistor configured to provide the data signal line with a voltage corresponding to the data signal; a drain of the driving transistor connected to the light emitting element and supplying a current according to a gate voltage of the driving transistor; a reset transistor configured to reset a voltage of a gate of the driving transistor; first and second transistors connected in series such that the drain and the gate of the driving transistor are diode connected, the first transistor being placed at a drain side of the driving transistor and the second transistor being placed at a gate side of the driving transistor; and a capacity element configured to hold a voltage provided to the gate of the driving transistor. A gate of the first transistor is connected to the first gate signal line and a gate of the second transistor is connected to the second gate signal line.

During a data write period where a threshold voltage of the driving transistor according to the data signal is compensated and a voltage is provided to the capacity element to hold a data signal compensated as a gate voltage of the driving transistor, signals for turning on the first transistor and the second transistor are provided to the first gate signal line and the second gate signal line, respectively. When the data write period is ended, a signal for turning off the second transistor is first provided to the second gate signal line, and afterwards a signal for turning off the first transistor is provided to the first gate signal line. After the first transistor is turned off, a signal for again turning on the second transistor is provided to the second gate signal line.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
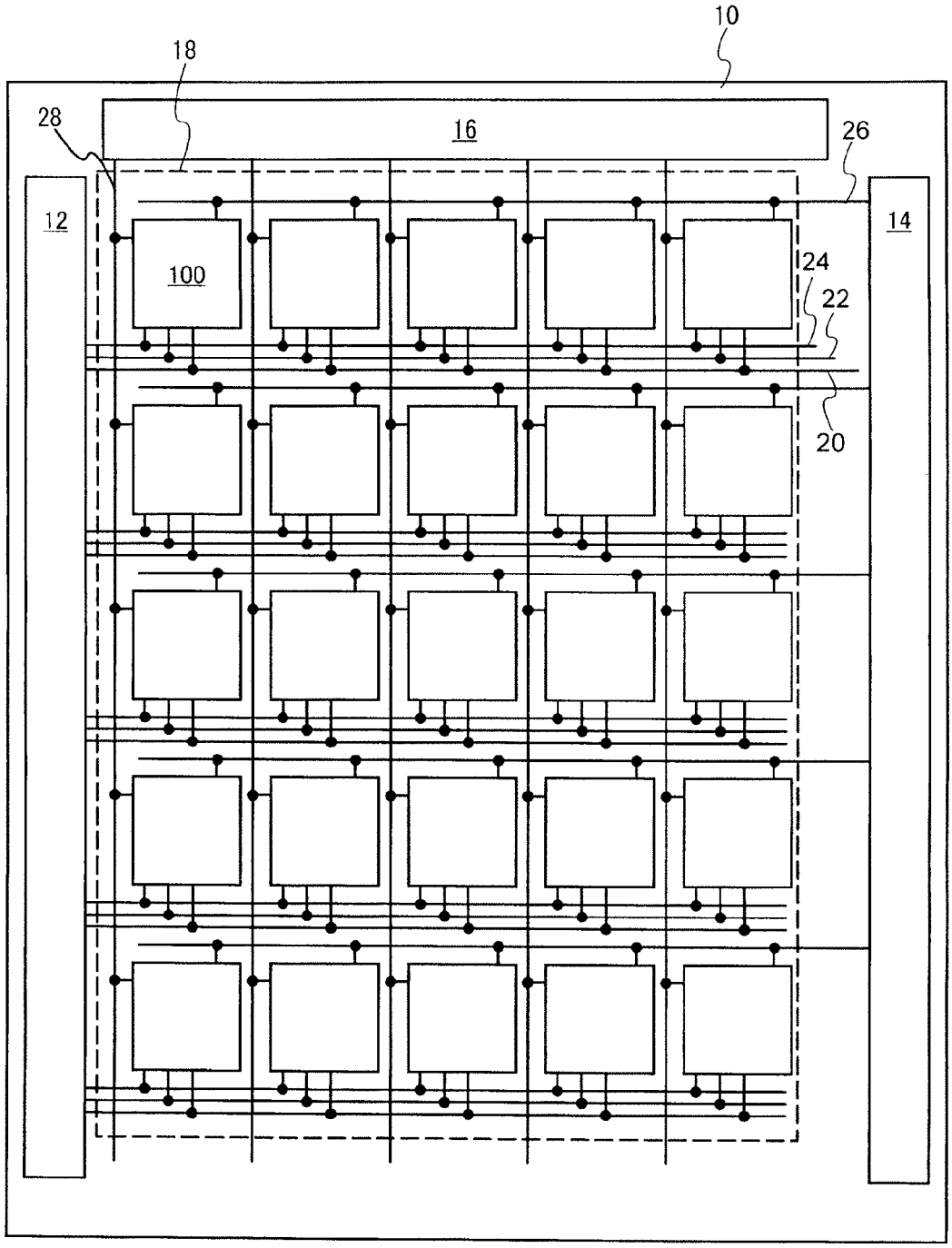
FIG. 1 illustrates a schematic block diagram of an electronic device according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

In embodiments which will be described below, for example, a circuit of controlling a drain current flowing to a current light-emitting element by compensating for a threshold voltage of a driving transistor is described using a pixel circuit of a p-channel transistor. However, embodiments are not limited thereto. For example, embodiments are applicable to the case that a pixel circuit is formed of an n-channel transistor or a CMOS transistor.

FIG. 1 illustrates a block diagram of an electro-optic device 10 according to an embodiment. The electro-optic device 10 includes a gate signal line driving circuit 12, a light-emitting control circuit 14, a data signal line driving circuit 16, and a pixel unit 18. The pixel unit 18 has a plurality of pixel circuits 100 arranged in a row direction and a column direction. The pixel circuits 100 are arranged to form a matrix, e.g., 5 rows and 5 columns. However, embodiments are not limited thereto, and the number of pixel circuits 100 may be increased or decreased.

Each pixel circuit 100 includes a plurality of transistors and a current light-emitting element. The current light-emitting element is a light-emitting element using an organic EL material as a light-emitting medium. In case of a light-emitting element the luminous intensity of which is varied according to the amount of current supplied, the current light-emitting element may be a light-emitting element having a material or a form different therefrom.

The gate signal line driving circuit 12 supplies selection signals to a first gate line 20, a second gate line 22 and a third gate line 24 configured to correspond to the pixel circuits 100 in each row. The gate signal line driving circuit 12 outputs a signal for selecting a row of pixel circuits 100 to the first gate line 20, a signal for reducing influence of kickback generated within the pixel circuits 100 to the second gate signal line 22, and a signal for resetting a data voltage supplied to the pixel circuits 100 to the third gate signal line 24.

The light-emitting control circuit 14 supplies a light-emitting control signal to a light-emitting control line 26 configured to correspond to the pixel circuits 100. The light-emitting control circuit 14 controls timing when a current is supplied to current light-emitting elements of pixel circuits 100 in each row in response to the light-emitting control signal.

The data line control circuit 16 provides a data signal line 28 with a data signal having a voltage level decided according to a gradation. The data signal line 28 is configured to correspond to pixel circuits 100 in each column and supplies a data signal to pixel circuits 100 selected by the first gate signal line 20.

The electro-optic device 10 shown in FIG. 1 is applicable to various electronic devices including a display unit for displaying an image, such as a smart phone, a cellular phone, a personal computer, a television receiver (e.g., a television receiver supporting bidirectional communication), and the like.

Below, a pixel circuit for suppressing influence of kickback generated when a transistor is turned on or off and an electro-optic device including the pixel circuit will be more fully described with reference to accompanying drawings.

First Embodiment

Figure 2:
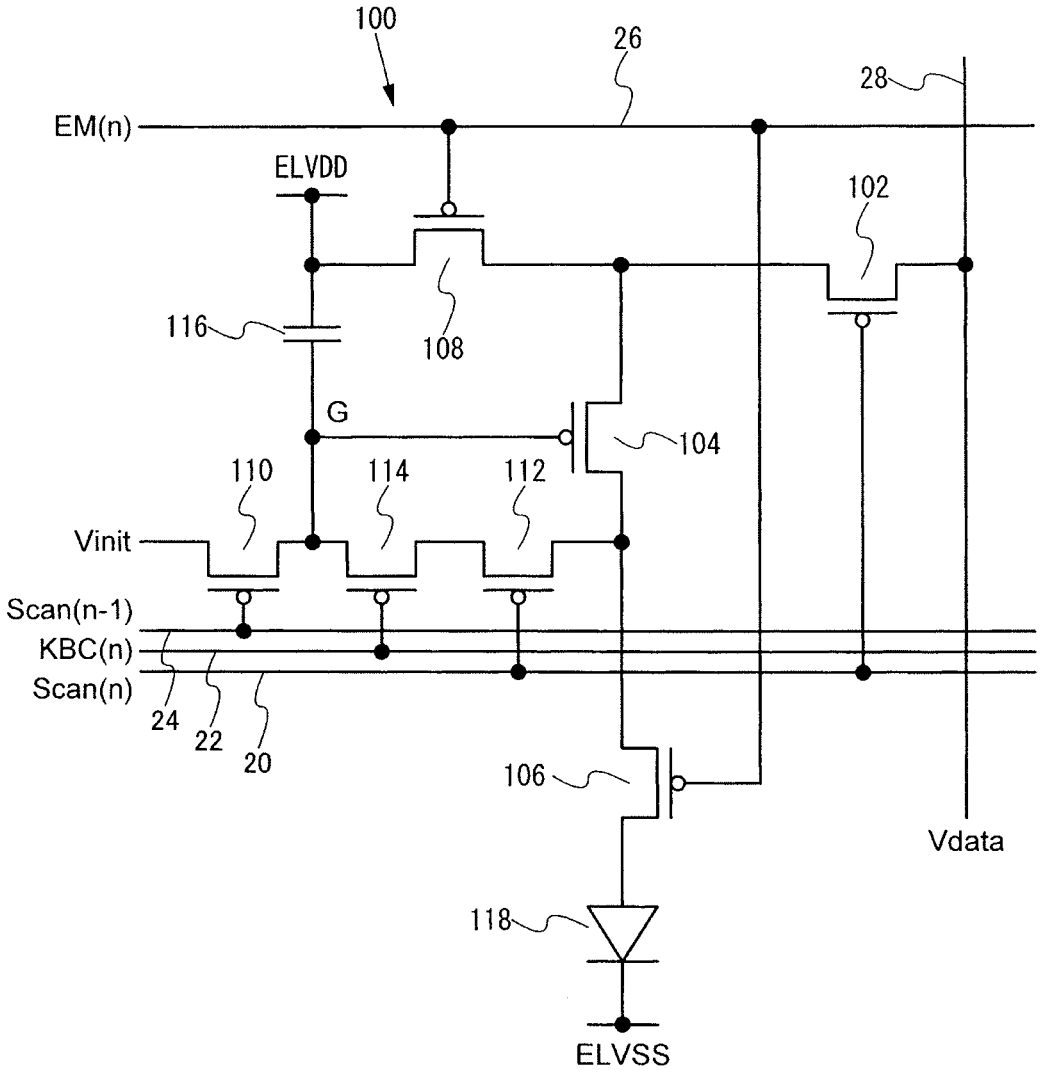
FIG. 2 illustrates a circuit diagram of a pixel circuit according to a first embodiment.

FIG. 2 illustrates a circuit diagram of a pixel circuit 100 according to a first embodiment. In FIG. 2, transistors of a pixel circuit 100 have a p-channel type. The pixel circuit 100 includes a transistor 102 to select whether to receive a data signal from a data signal line 28, a driving transistor 104 to control a flow of a drain current corresponding to a data signal written, and a current light-emitting element 118 to which the drain current of the driving transistor 104 is supplied.

One of a source and a drain of the transistor 102 is connected to the data signal line 28, and another one thereof is connected to a source of the driving transistor 104. A gate of the transistor 102 is connected to a first gate signal line 20. If a selection signal is provided from the first gate signal line 20, the transistor 102 is turned on, so that a data signal is supplied from the data signal line 28 to the driving transistor 104. Therefore, the transistor 102 is a write control transistor which controls writing of a data signal at the pixel circuit.

A drain and a gate of the driving transistor 104 are diode connected by a first transistor 112 and a second transistor 114. Here, the first transistor 112 is connected to a drain of the driving transistor 104 and the second transistor 114 is connected to a gate of the driving transistor 104. Since the first and second transistors 112 and 114 are connected in series, the driving transistor 104 is viewed as a diode connected transistor when the first and second transistors 112 and 114 are turned on.

Both the first transistor 112 and the second transistor 114 are turned on during a data write period. When the data write period ends, a signal for turning off the second transistor 114 is first provided to a second gate signal line 22 and, then, a signal for turning off the first transistor 112 is provided to a first gate signal line 20. Afterwards, a signal for turning on the second transistor 114 is again provided to the second gate signal line 22. With this operation, a variation (e.g., influence of kickback) in a gate voltage caused by switch operations of transistors used for diode connection of the driving transistor 104 may be reduced or eliminated.

A capacity element 116 for holding a voltage corresponding to a data signal is connected to a gate of the driving transistor 104. The capacity element 116 has a first end connected to the gate of the driving transistor 104 and a second end connected to a power line ELVDD having a high potential. As will be described below, the capacity element 116 holds a voltage corresponding to a data voltage written at the pixel circuit 100.

A transistor 110 may serve as a reset transistor to set (or, initialize) a gate voltage of the driving transistor 104 to an initial voltage Vinit. A gate of the transistor 110 is connected to a third gate signal line 24. If the transistor 110 is turned on by an initial signal, a gate voltage of the driving transistor 104 is set to the initial voltage Vinit, so that a data signal written is reset.

The current light-emitting element 118 is connected between the drain of the driving transistor 104 and a power line ELVSS having a low potential. As a switching element, a transistor 106 is connected between the current light-emitting element 118 and the drain of the driving transistor 104. As a switching element, a transistor 108 is connected between the power line ELVDD and the driving transistor 104.

The transistors 106 and 108 are turned on or off by a light-emitting control signal EM supplied from the light-emitting control line 26. When the transistors 106 and 108 are turned off, a supply of a current to the current light-emitting element 118 is blocked. At this time, the current light-emitting element 108 does not emit light. When the transistors 106 and 108 are turned on, current is supplied to the current light-emitting element 118. Since a drain current according to a gate voltage of the driving transistor 104 is supplied to the current light-emitting element 118, the current light-emitting element 118 emits light. With the above description, the transistors 106 and 108 function as a light-emitting control transistor.

A current flowing between the source and the drain of the driving transistor 104 is controlled according to a gate voltage applied to the gate of the driving transistor 104, so that a luminous intensity of the current light-emitting element 118 is controlled. A gate voltage of the driving transistor 104 is varied according to a voltage level of a data signal written at the pixel circuit 100.

Figure 3:
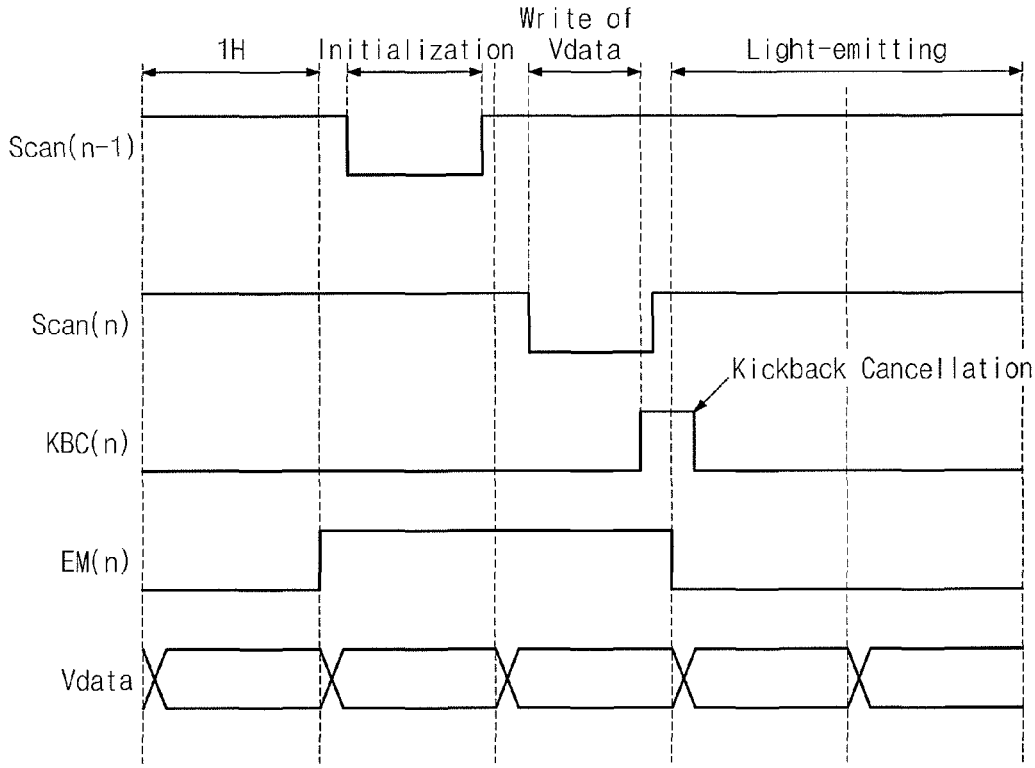
FIG. 3 illustrates a timing diagram for describing an operation of a pixel circuit according to a first embodiment.

FIG. 3 illustrates a timing diagram for describing an operation of a pixel circuit 100 of FIG. 2 according to a first embodiment. A timing diagram of FIG. 3 shows signals Scan (n), KBC(n), and Scan(n−1) supplied to first to third gate signal lines 20 to 24, respectively, and a signal EM(n) supplied to a light-emitting control line 26 with respect to an initialization period, a data write period, and a light-emitting period. Here, 'n' indicates a row of pixel circuits 100 (n=1, 2, . . . ).

As illustrated in FIG. 3, during the initialization period, a high level of signal Scan(n) is provided to the first gate signal line 20, a low level of signal KBC(n) is provided to the second gate signal line 22, and a low level of signal Scan(n−1) is provided to the third gate signal line 24. Referring to a pixel circuit 100, under this condition, the first transistor 112 is turned off, and the second transistor 114 and the reset transistor 110 are turned on. At this time, since an initial voltage Vinit is provided to a gate of a driving transistor 104 through the reset transistor 110, a gate voltage is initialized.

During the data write period, the signal Scan(n) provided to the first gate signal line 20 transitions from a high level to a low level, the signal KBC(n) provided to the second gate signal line 22 is at a low level, and the signal Scan(n−1) provided to the third gate signal line 24 goes to a high level. At this time, a transistor 102 is turned on by the signal Scan(n) of the first gate signal line 20, and a data signal is provided from a data signal line 28 to the driving transistor 104. Since the first transistor 112 is turned on and the second transistor 114 is turned on by the signal KBC(n), the driving transistor 104 is diode connected. Thus, a voltage level of the data signal is provided to a gate of the driving transistor 104 through the first and second transistors 112 and 114.

Since a drain and a gate of the driving transistor 104 are diode connected, a gate voltage Vg of the driving transistor 104 is set to a voltage (Vdata−Vth) (here, Vdata indicating a data voltage and Vth indicating a threshold voltage of the driving transistor 104), and the voltage (Vdata−Vth) is provided to the capacity element 116.

During the light-emitting period, the first gate signal line 20 and the third gate signal line 24 have a high level, and the signal EM(n) of the light-emitting control line transitions from a high level to a low level. As understood from the pixel circuit 100 shown in FIG. 2, since current flows from a power line ELVDD having a high potential to the current light-emitting element 118 through the driving transistor 104, light is emitted. At this time, a current flowing to the current light-emitting element 118 corresponds to a drain current of the driving transistor 104. A drain current of the driving transistor 104 is easily changed by a threshold voltage. But, according to embodiments, during the write period, a variation of a threshold voltage of the driving transistor 104 may be detected and compensated. For this reason, influence of a threshold voltage on a drain current flowing to the current light-emitting element 118 is reduced or eliminated.

Influence of kickback during the data write period is problematic. However, to reduce or prevent such influence, operations of the first and second transistors 112 and 114 used for diode connection of the driving transistor 104 are controlled as follows.

When the data write period is ended, at least one of the first and second transistors 112 and 114 need be turned off to hold a gate voltage by blocking a conduction state between a gate and a drain of the transistor 104. At this time, the signal KBC(n) provided to the second gate signal line 22 first transitions from a low level to a high level. Then, the signal Scan(n) provided to the first gate signal line 20 transitions from a low level to a high level. Thus, the second transistor 114 close to the gate of the driving transistor 104, i.e., between the gate and the first transistor 112, is first turned off, and the first transistor 112 is then turned off. That is, the first and second transistors 112 and 114 are not turned off at the same time.

At a next period, i.e., the light-emitting period, the signal KBC(n) provided to the second gate signal line 22 transitions from a high level to a low level such that the second transistor 114 is turned on. Also, the signal EM(n) transitions from a high level to a low level before the second transistor 114 is turned on, but after the first transistor 112 is turned off.

In exemplary embodiments, it is possible to prevent a gate voltage from being changed, e.g., due to kickback, by operating the first and second transistors 112 and 114 used for diode connection of the driving transistor 104 during the data write period as described above. This will be more fully described below.

Figure 14:
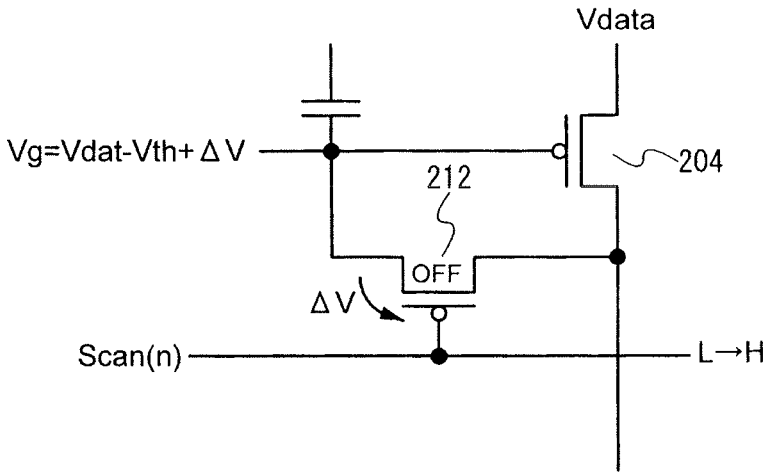
FIG. 14 illustrates a circuit diagram for describing an operation of a pixel circuit where a drain and a gate of a driving transistor is diode connected.

Influence of kickback generated when data is written at the driving transistor is described with reference to FIG. 14. A transistor 212 is diode connected to a driving transistor 204. During a data write period, the transistor 212 is turned on and a voltage of a data signal is provided to a gate of the driving transistor 204. If the transistor 212 is turned off according to an end of the data write period, a gate voltage Vg of the driving transistor 204 is changed by ΔV by kickback (Vg=Vdata−Vth+ΔV).

In the pixel circuit 100 according to embodiments, variation of a gate voltage of the driving transistor 104 is reduced or prevented by making operation timing of the first and second transistors 112 and 114 different.

Figure 4A:
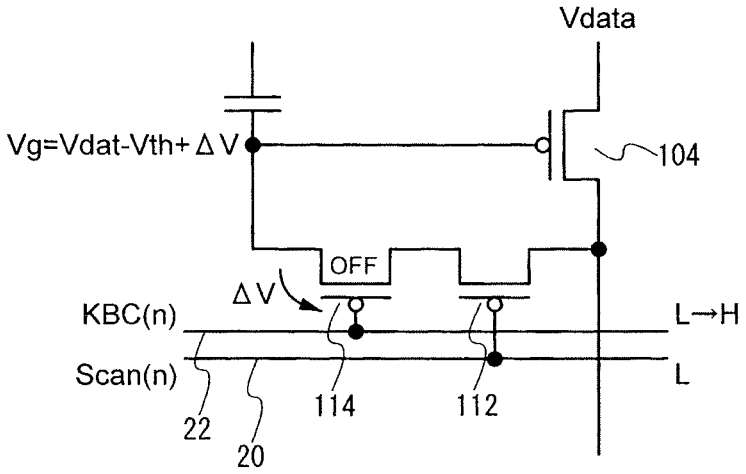
FIGS. 4A to 4C illustrate circuit diagrams for describing an operation of the pixel circuit of FIG. 2 according to a first embodiment.

FIG. 4A illustrates a case in which, after a data write period is ended, the second transistor 114 is first turned off while the first transistor 112 is still on. In this case, a gate voltage Vg of the driving transistor 104 is set to (Vdata−Vth+ΔV), and a voltage is changed by ΔV due to kickback of the second transistor 114.

Figure 4B:
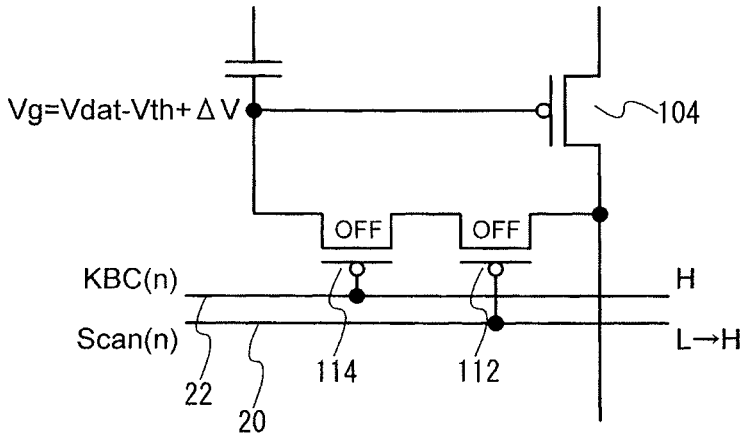

FIG. 4B illustrates a case in which the first transistor 112 is turned off after the second transistor 114 has been turned off. In this case, since the second transistor 114 close to the driving transistor 104 is turned off, the gate voltage Vg is not varied by kickback although the first transistor 112 is turned off.

Figure 4C:
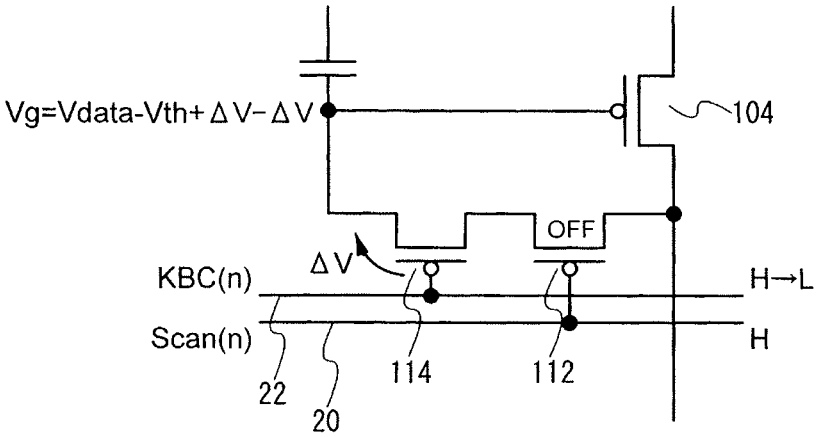

FIG. 4C illustrates a case in which the second transistor 114 is only turned on after a state of FIG. 4B in which the first and second transistors 112 and 114 were turned off. As charges are redistributed by turning on the second transistor 114 with the first transistor 112 being turned off, the gate voltage Vg of the driving transistor 104 becomes (Vdata−Vth+ΔV−ΔV). That is, a voltage ΔV due to kickback generated when the second transistor 114 is first turned off is cancelled by again turning on the second transistor 114 with the first transistor 112 turned off.

Also, during the data write period, a gate voltage of the driving transistor 104 is changed from the initial voltage Vinit to a voltage (Vdata−Vth) according to a data voltage. A drain current of the driving transistor 104 continuously flows until its gate voltage is saturated up to the voltage (Vdata−Vth) according to a data voltage. However, if the data write period is finite and data is written using a constant frame frequency to display an image, the data write period ends before the gate voltage of the driving transistor 104 is fully saturated. Therefore, the second transistor 114 used for diode connection may easily influence kickback, as the second transistor 114 is turned off with a drain current flowing (or, with channel charges remaining).

However, as illustrated in FIGS. 4A to 4C, influence of kickback on a gate of the driving transistor 104 is suppressed by making on/off timing of the first and second transistors 112 and 114 different.

As described above, influence of kickback on a gate of the driving transistor 104 may be reduced or eliminated by first turning off a transistor, proximate to a gate of the driving transistor 104, from among a plurality of transistors used for diode connection of the driving transistor 104, turning off the remaining transistors used for diode connection of the driving transistor 104, and again turning on the transistor proximate to a gate of the driving transistor 104. Display unevenness of an electro-optic device 10 is improved by reducing a variation in a driving voltage of the driving transistor 104 included in the pixel circuit 100.

Second Embodiment

A pixel circuit 100 according to a second embodiment of the inventive concepts will be more fully described with reference to FIGS. 5 and 6.

Figure 5:
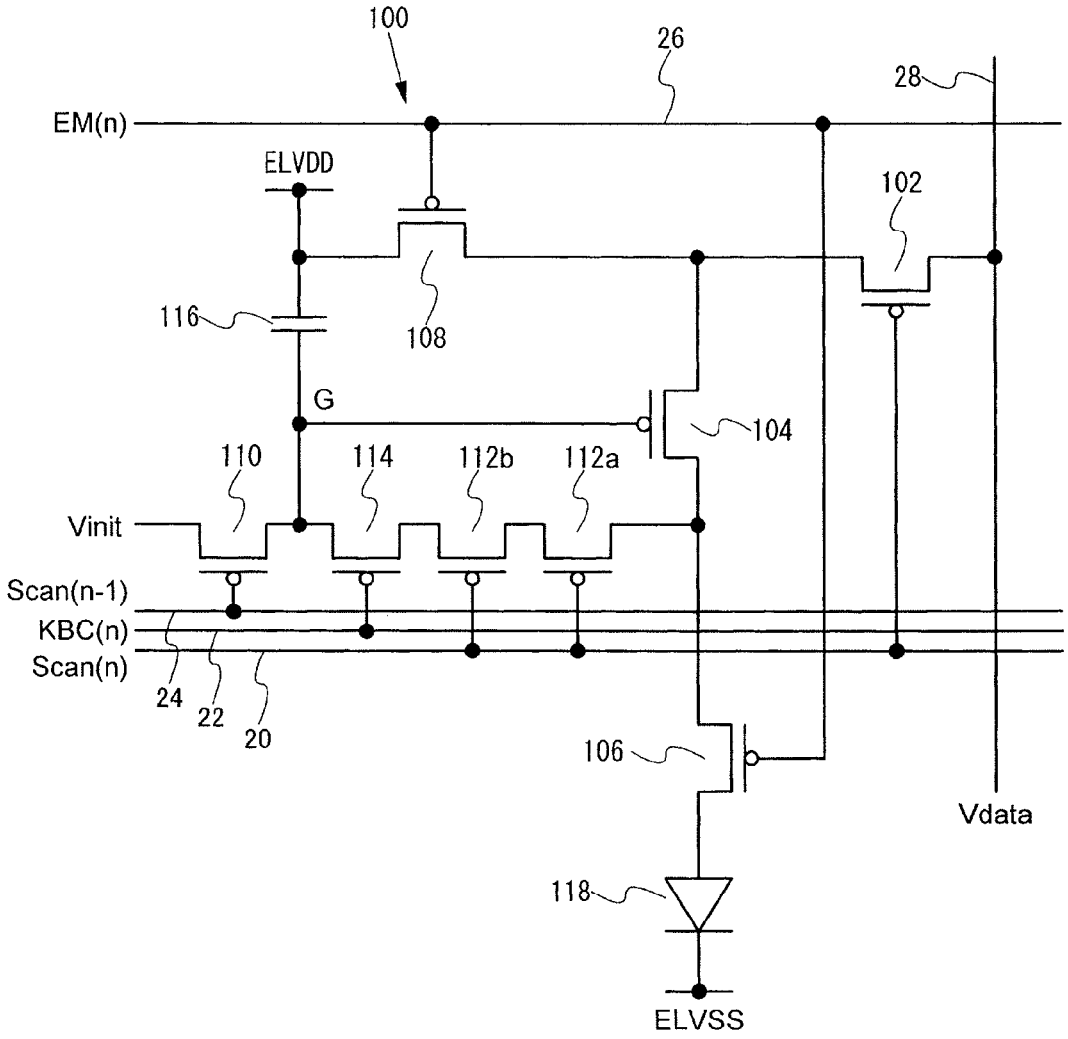
FIG. 5 illustrates a circuit diagram of a pixel circuit according to a second embodiment.

In FIG. 5, a first transistor connected to a drain side of a driving transistor 104 is formed of a multi-gate structure. That is, a first transistor 112*a*, a third transistor 112*b*, and a second transistor 114 are connected between a drain and a gate of the driving transistor 104. Since the first and third transistors 112*a* and 112*b* are connected to a first gate signal line 20, they are turned on or off at the same timing. The third transistor 112*b* may be formed of a plurality of transistors in series connected. In exemplary embodiments, the third transistor 112*b* may be formed of at least one transistor.

Figure 6A:
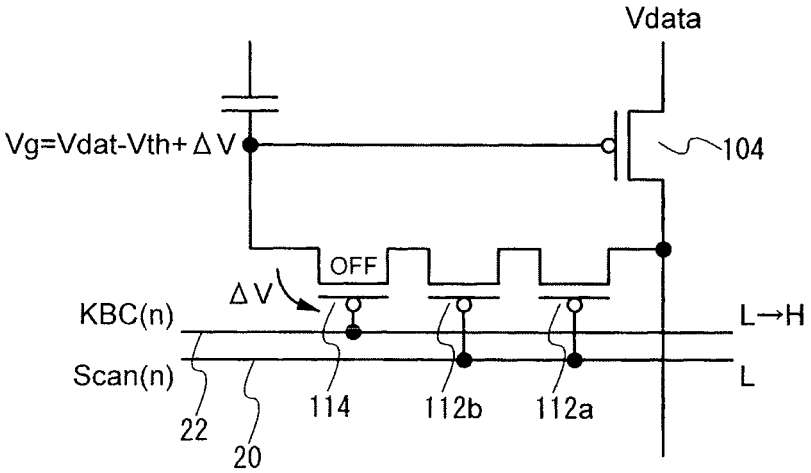
FIGS. 6A to 6C illustrates a circuit diagram for describing an operation of the pixel circuit of FIG. 5 according to a second embodiment.
Figure 6B:
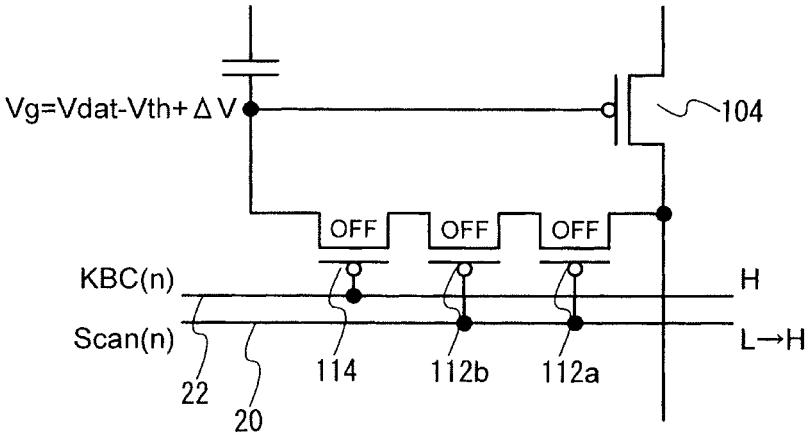
Figure 6C:
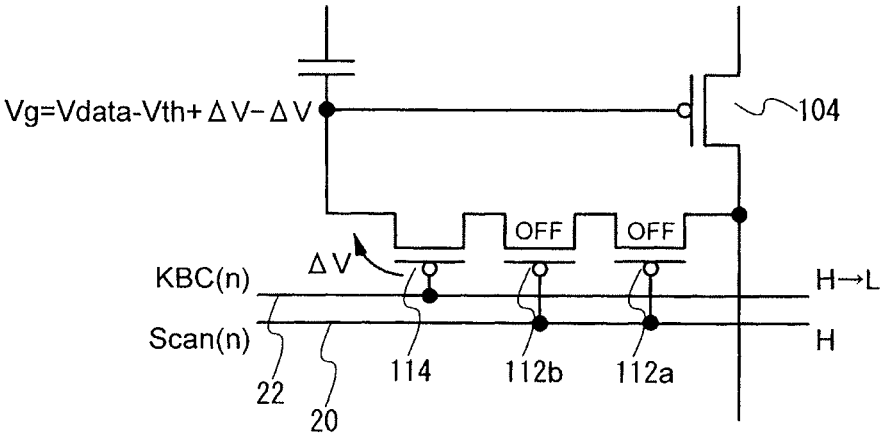

An operation of the pixel circuit 100 is substantially the same as that described with reference to a timing diagram shown in FIG. 3, and a description thereof is thus omitted. FIG. 6A to 6C illustrates detailed operations of the first transistor 112*a*, the third transistor 112*b*, and the second transistor 114.

Referring to FIG. 6A, when a data write period is ended, a second transistor 114 is first turned off with the first and third transistors 112*a* and 112*b* turned off. At this time, a gate voltage Vg of the driving transistor 104 is (Vdata−Vth+ΔV).

FIG. 6B illustrates such a state that the first and third transistors 112*a* and 112*b* are turned off following the second transistor 114. As illustrated in FIG. 6C, the second transistor 114 is only turned on with the first and third transistors 112*a* and 112*b* turned off. This operation is substantially the same as that described with reference to FIG. 4. Since a gate voltage Vg of the driving transistor 104 is (Vdata−Vth+ΔV−ΔV), influence of kickback is compensated.

In exemplary embodiments, a current (or, a leak current) flowing at a turn-off state of a first transistor is reduced by forming the first transistor to have a multi-gate structure (or, by connecting a transistor corresponding to the first transistor in plurality in series).

That is, as described with reference to FIG. 4, in the event that a data signal is provided to a source of the driving transistor 104, a drain current does not flow when a data write period is ended before a gate voltage of the driving transistor 104 is fully saturated. Thus, a leak current when the first transistor is turned off may be minimized to reduce influence of kickback.

As illustrated in FIGS. 5 to 6C, a leak current is reduced by connecting a multi-gate structured transistor to a drain side of the driving transistor 104 (or, by connecting a transistor corresponding to the first transistor in plurality in series). After the first and third transistors 112*a* and 112*b* are turned off, the second transistor 114 is turned on. In this case, however, a variation in a gate voltage of the driving transistor 104 may be prevented. The reason is that a leak current is reduced by a multi-gate type transistor formed of the first transistor 112*a* and the third transistor 112*b*.

While the first and third transistors 112*a* and 112*b* described above are commonly connected to the first gate signal line 20, embodiments are not limited thereto. For example, the first and third transistors 112*a* and 112*b* may be connected to different gate signal lines. In this case, the first and third transistors 112*a* and 112*b* may be turned on or off at the same timing or at different timing, depending on the period. For example, the first and third transistors 112*a* and 112*b* may be turned off at the same time during a light-emitting period.

As described above, a transistor, proximate to a drain of the driving transistor 104, from among a plurality of transistors used for diode connection of the driving transistor 104 is formed to have a multi-gate structure, so that a leak current is reduced and influence due to kickback of a gate voltage of the driving transistor 104 is removed. Thus, display unevenness of an electro-optic device 10 is improved by reducing a variation in a driving voltage of the driving transistor 104 included in the pixel circuit 100.

Third Embodiment

In the first and second embodiments, there is described such a structure that influence of kickback due to a transistor used for diode connection of a driving transistor 104 is reduced. However, influence at a drain side of the driving transistor 104 may be reduced or removed to further reduce influence of kickback on a gate voltage of the driving transistor 104. How kickback on a gate voltage of the driving transistor 104 acts at a drain side of the driving transistor 104 is described with reference to FIGS. 7A to 7C.

Figure 7A:
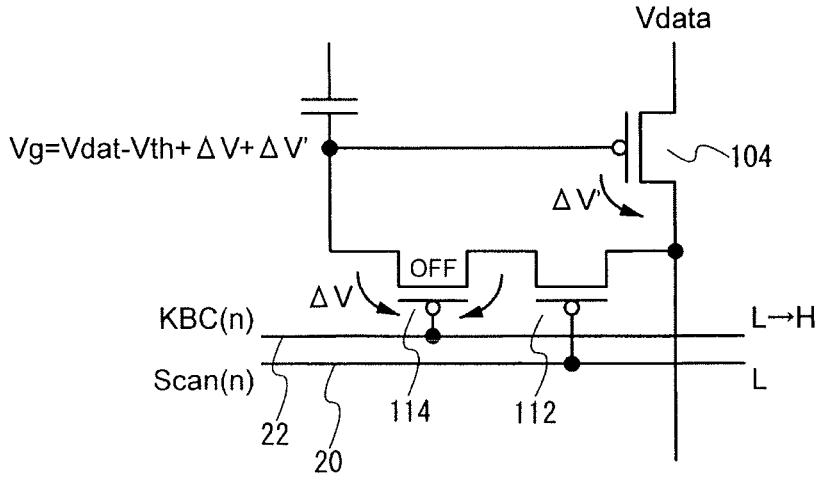
FIGS. 7A to 7C illustrate circuit diagrams for describing an operation of the pixel circuit of FIG. 2.

As illustrated in FIG. 7A, if a second transistor 114 is first turned off at a data write period, a voltage ΔV due to kickback when the second transistor 114 is turned off is added to a gate voltage Vg of the driving transistor 104, and a voltage ΔV' generated between a gate and a drain of the driving transistor 104 is further added to the gate voltage Vg of the driving transistor 104. That is, the gate voltage Vg of the driving transistor 104 becomes (Vdata−Vth+ΔV+ΔV'). The voltage ΔV' generated between a gate and a drain of the driving transistor 104 is generated by turning off the second transistor 114.

Figure 7B:
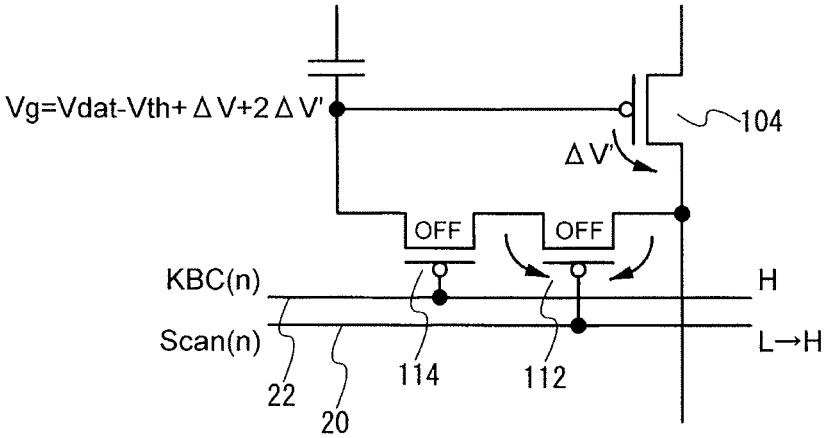

As illustrated in FIG. 7B, influence of kickback when a first transistor 112 is turned off is further added to a gate of the driving transistor 104 through a parasitic capacity Cgd of a drain side of the driving transistor 104. Thus, the gate voltage Vg of the driving transistor 104 becomes (Vdata−Vth+ΔV+2ΔV').

Figure 7C:
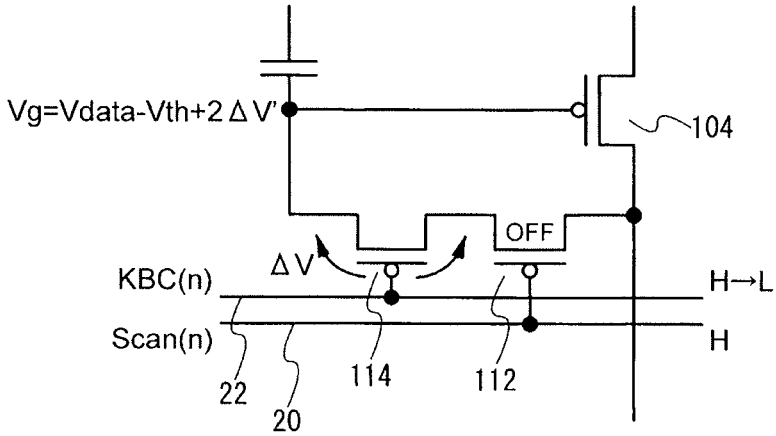

As illustrated in FIG. 7C, if the second transistor 114 is again turned on after the first transistor 112 is turned off, the voltage ΔV due to kickback of the second transistor 114 is cancelled. However, the voltage ΔV' between a gate and a drain of the driving transistor 104 is provided to a gate of the driving transistor 104 as a kickback voltage. That is, the gate voltage Vg of the driving transistor 104 becomes (Vdata−Vth+2ΔV').

Figure 8:
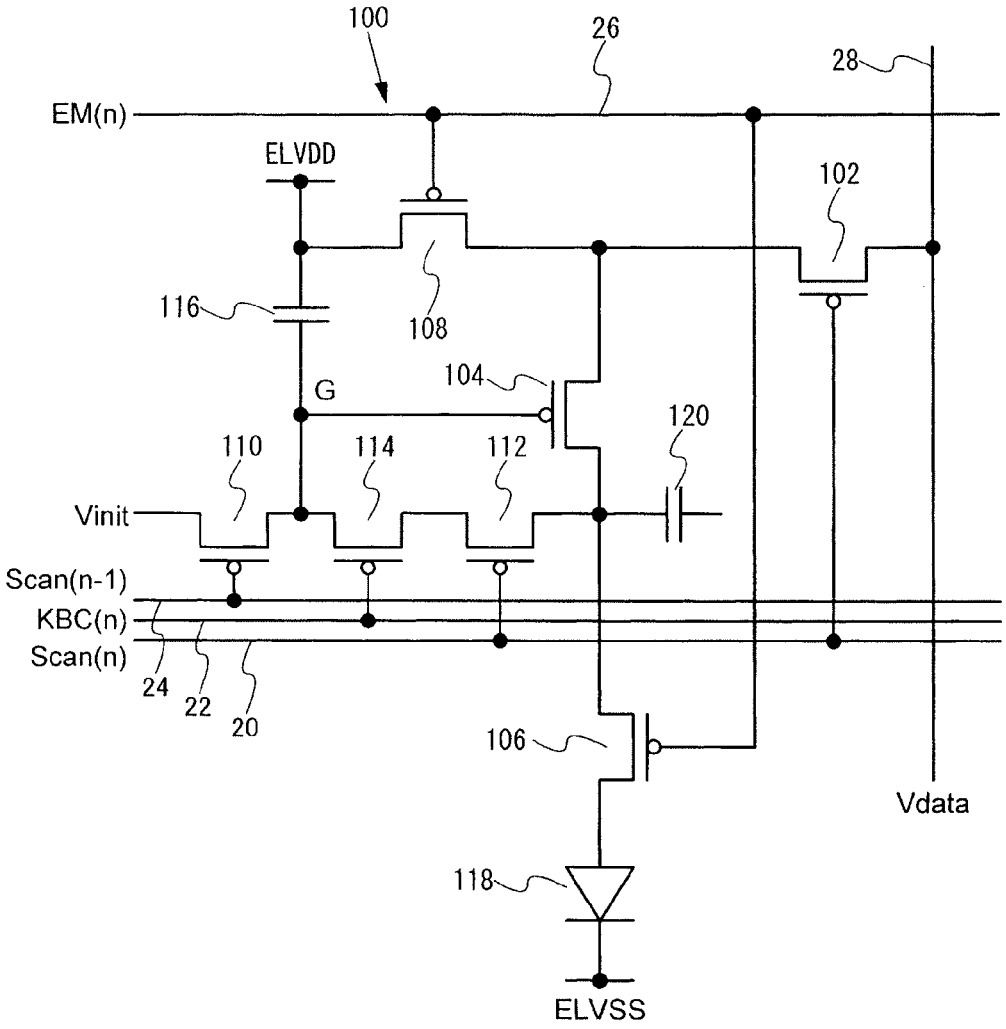
FIG. 8 illustrates a schematic circuit diagram of a pixel circuit according to a third embodiment.

FIG. 8 illustrates a third embodiment where a capacity element 120 is connected in parallel with a drain of a driving transistor 104 to reduce the above-described influence. Charges redistributed at the driving transistor 104 are absorbed when a second transistor 114 is turned off by connecting a capacity element 120 in parallel with a drain of the driving transistor 104.

In exemplary embodiments, there is reduced a variation in a drain voltage of the driving transistor 104 due to kickback of the second transistor 114 used for diode connection of the driving transistor 104. This means that influence of kickback generated at a gate of the driving transistor 104 is reduced. Thus, display unevenness of an electro-optic device 10 is improved by reducing a variation in a driving voltage of the driving transistor 104 included in the pixel circuit 100.

A configuration of the third embodiment is implemented through combination of other embodiments.

Fourth Embodiment

In the fourth embodiment, in a pixel circuit 100 shown in FIG. 2 according to a first embodiment, influence of kickback is reduced using a parasitic capacity of a current light-emitting element. The pixel circuit according to the fourth embodiment of the inventive concepts is substantially the same as that described with reference to FIG. 2, and a description thereof is thus omitted.

Figure 9:
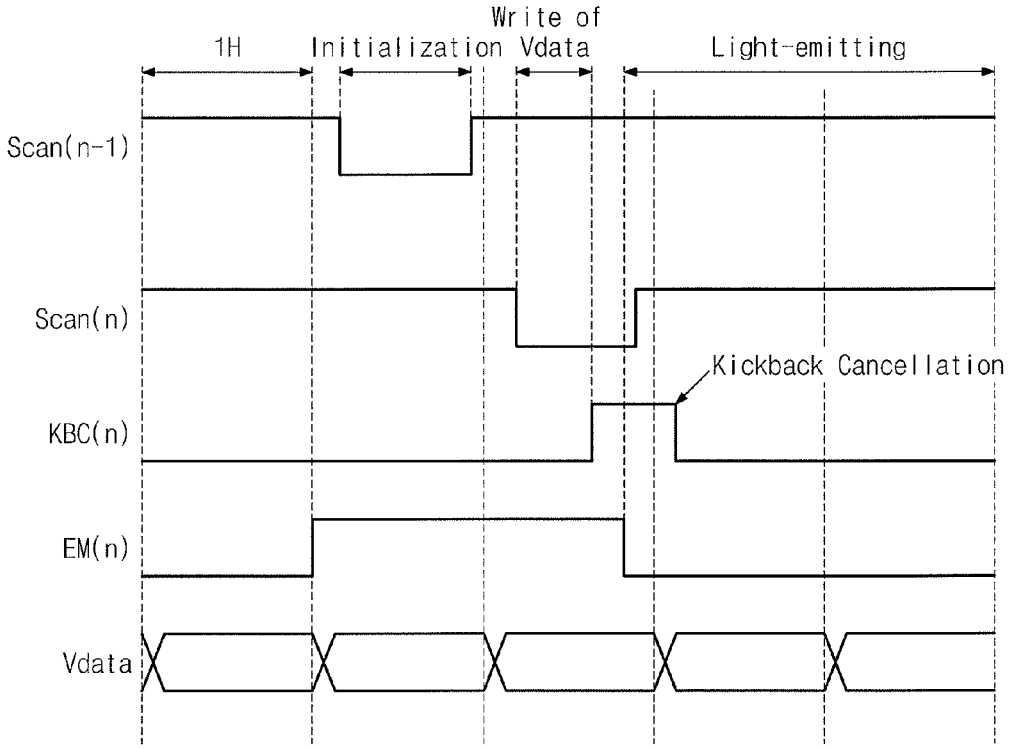
FIG. 9 illustrates a timing diagram for describing an operation of the pixel circuit of FIG. 2 according to a fourth embodiment.

FIG. 9 illustrates a timing diagram for describing an operation of a pixel circuit 100 according to a fourth embodiment of the inventive concepts. A timing diagram of FIG. 9 shows signals Scan(n), KBC(n), and Scan(n−1) of first to third gate signal lines 20 to 24, respectively, and a signal EM(n) of a light-emitting control line 26 with respect to an initialization period, a data write period, and a light-emitting period.

During the initialization period, a high level of signal Scan (n) is provided to the first gate signal line 20, a low level of signal KBC(n) is provided to the second gate signal line 22, and a low level of signal Scan(n−1) is provided to the third gate signal line 24. Therefore, in a pixel circuit 100 shown in FIG. 2, since an initial voltage Vinit is provided to a gate of a driving transistor 104 through the transistor 110, a gate voltage is initialized.

During the data write period, the signal Scan(n) provided to the first gate signal line 20 transitions from a high level to a low level, the signal KBC(n) provided to the second gate signal line 22 goes to a low level, and the signal Scan(n−1) provided to the third gate signal line 24 goes to a high level. At this time, a transistor 102 is turned on by the signal Scan(n) of the first gate signal line 20, and a data signal is provided from a data signal line 28 to the driving transistor 104. Since the first transistor 112 is turned on and the second transistor 114 is turned on by the signal KBC(n) of the second gate signal line 22, the driving transistor 104 is diode connected. Thus, a voltage level of the data signal is provided to a gate of the driving transistor 104 through the first and second transistors 112 and 114.

Since the signal EM(n) of the light-emitting control line 26 maintains a high level during the initialization and data write periods, the transistor 106 (e.g., a light-emitting control transistor) for controlling light-emitting of a current light-emitting element 118 maintains a turn-off state.

Since a drain and a gate of the driving transistor 104 are diode connected, a gate voltage Vg of the driving transistor 104 is set to a voltage (Vdata−Vth) (here, Vdata indicating a data voltage and Vth indicating a threshold voltage of the driving transistor 104), and the voltage (Vdata−Vth) is provided to a capacity element 116.

When the data write period is ended, the signal KBC(n) provided to the second gate signal line 22 first transitions from a low level to a high level and the second transistor 114 is turned off. Afterwards, the signal EM(n) provided to the light-emitting control line 26 goes a low level and a transistor 106 is turned on. The signal Scan(n) of the first gate signal line 20 transitions to a high level and the first transistor 112 is turned off. For example, as shown in FIG. 9, the signal Scan (n) may transition to a high level after the signal EM(n) goes to a low level.

As described, since the signal EM(n) of the light-emitting control line 26 is provided to turn on the transistor 106 being a light-emitting transistor after the second transistor 114 is turned off and before the first transistor 112 is turned off. Thus, the light-emitting period is maintained without variation. In the light-emitting period, the signal KBC(n) of the second gate signal line 22 is provided as a signal that transitions from a high level to a low level, and the second transistor 114 is switched into a turn-on state.

In exemplary embodiments, since the transistor 106 being a light-emitting transistor is turned on after the second transistor 114 is turned off and before the first transistor 112 is turned off, it is possible to remove a kickback voltage using a parasitic capacity of a current light-emitting element 118. This will be more fully described with reference to FIGS. 10A to 11B.

Figure 10A:
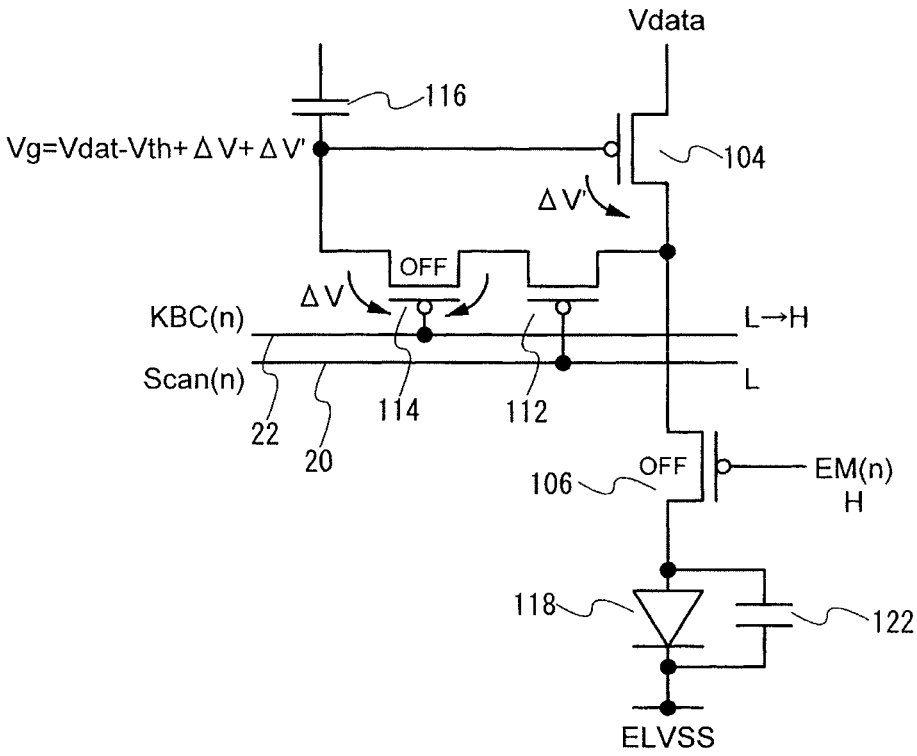
FIGS. 10A and 10B illustrate circuit diagrams for describing an operation of the pixel circuit of FIG. 2 according to a fourth embodiment.

As illustrated in FIG. 10A, if a second transistor 114 is first turned off at a data write period, a kickback voltage ΔV generated when the second transistor 114 is turned off is added to a gate voltage Vg of a driving transistor 104, and a voltage ΔV' generated between a gate and a drain of the driving transistor 104 is further added to the gate voltage Vg of the driving transistor 104. That is, the gate voltage Vg of the driving transistor 104 becomes (Vdata−Vth+ΔV+ΔV'). At this time, since a transistor 106 placed between a drain of the driving transistor 104 and the current light-emitting element 118 is at a turn-off state, a parasitic capacity 122 of the current light-emitting element 118 does not exist.

Figure 10B:
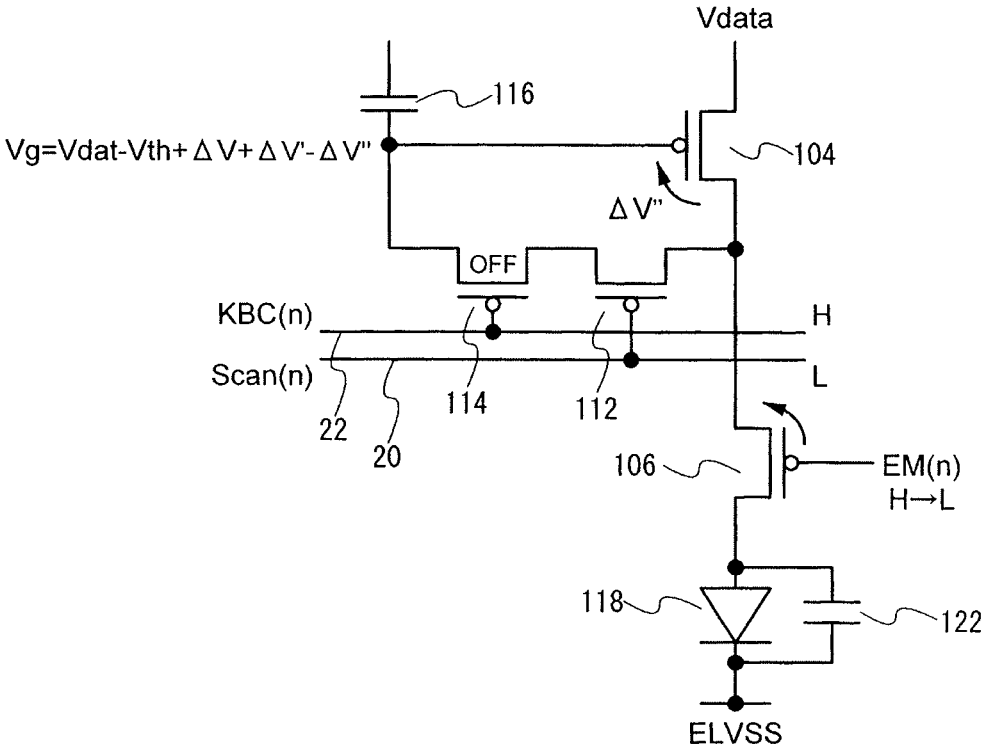

FIG. 10B illustrates such a state that the first transistor 112 is turned on, the second transistor 114 is turned off, and the transistor 106 being a light-emitting transistor is turned on. When the transistor 106 is turned on, a drain of the driving transistor 104 is gradually connected to the parasitic capacity 122 of the current light-emitting element 118. At this time, a voltage ΔV" is generated between a drain and a gate of the driving transistor 104 due to kickback. Therefore, a gate voltage Vg of the driving transistor 104 becomes (Vdata−Vth+ΔV+ΔV'−ΔV").

Figure 11A:
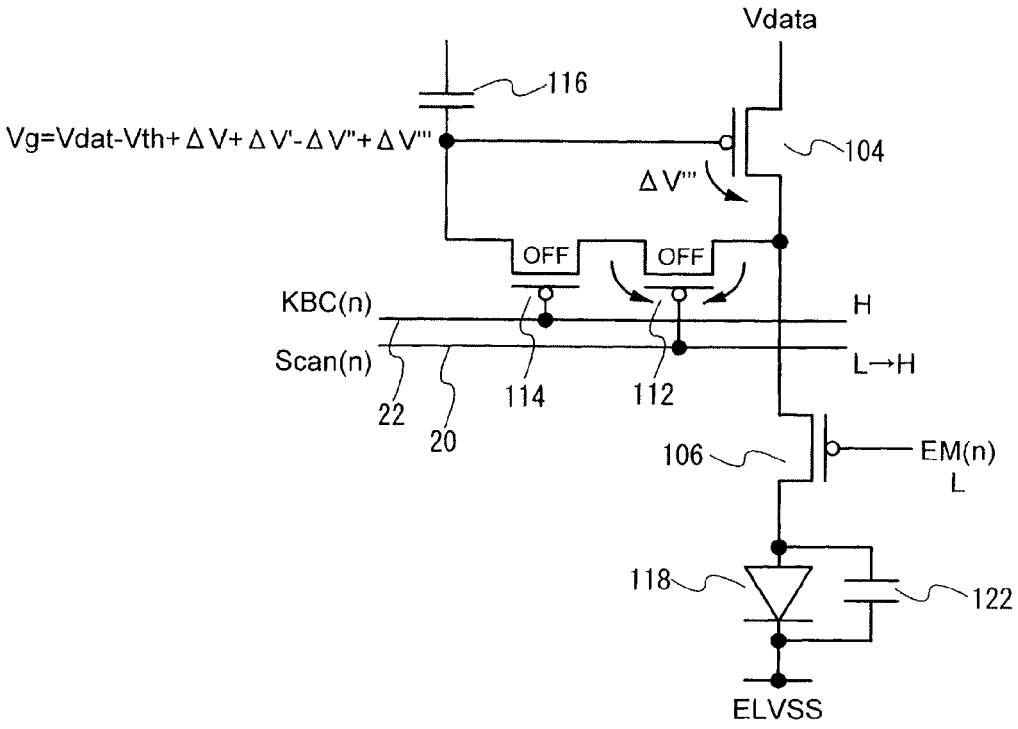
FIGS. 11A to 11B illustrate circuit diagrams for describing an operation of the pixel circuit of FIG. 2 according to a fourth embodiment.

FIG. 11A illustrates such a state that the first transistor 112 is turned off with the second transistor 114 and the transistor 106 turned on. At this time, a voltage ΔV'" is generated by kickback of a drain of a driving transistor 104. However, since a parasitic capacity 122 of a current light-emitting element 118 is connected to a drain of the driving transistor 104, a gate voltage Vg of the driving transistor 104 becomes (Vdata−Vth+ΔV+ΔV'−ΔV"+ΔV'").

Figure 11B:
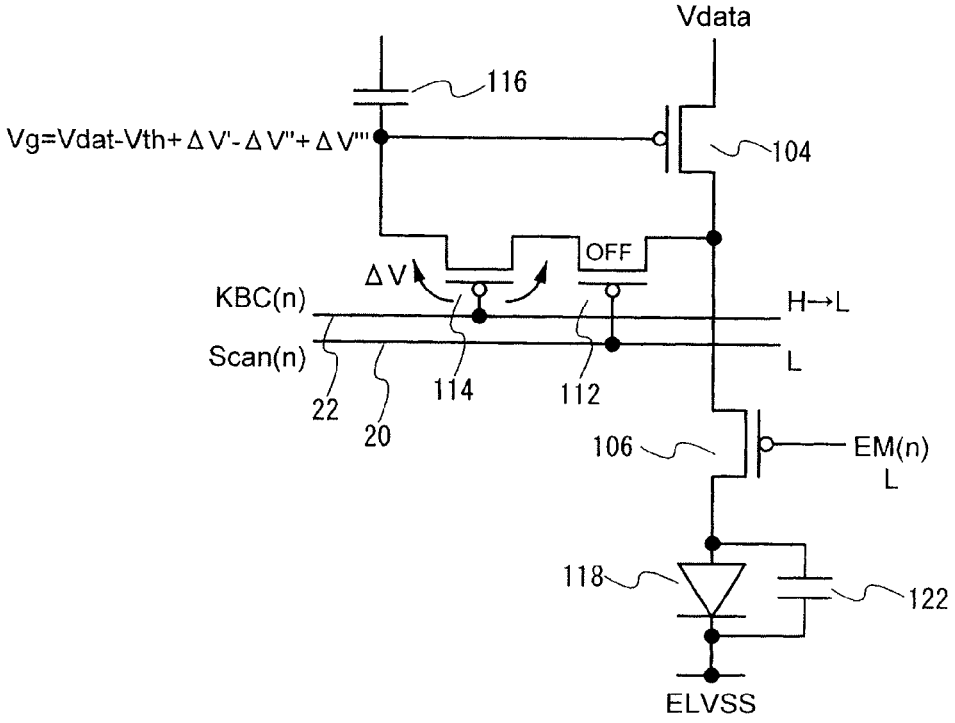

FIG. 11B illustrates such a state that a first transistor 112 is again turned on with a second transistor 114 turned off and with a transistor 106 turned on. In a gate voltage Vg of a driving transistor 104, a voltage ΔV due to kickback of a second transistor 114 is cancelled, and the gate voltage Vg of the driving transistor 104 becomes (Vdata−Vth+ΔV'−ΔV"+ΔV'").

Here, ΔV>>ΔV'>>ΔV">>ΔV'". The reason is as follows. First, referring to ΔV and ΔV', since ΔV' is determined by a capacitance Cst of a capacity element 116 and a capacitance Cgd between a gate and a drain of a driving transistor 104 and Cst>>Cgd, ΔV' is smaller than ΔV. When the transistor 106 is turned on, a drain of the driving transistor 104 is slowly connected to the parasitic capacity 122 and is influenced by kickback. However, since a parasitic capacity 122 is larger than that corresponding to the size of a current light-emitting element, ΔV" is smaller than ΔV' when a drain of the driving transistor 104 is floated. Also, since the first transistor 112 is turned off with a drain of the driving transistor 104 connected to the parasitic capacity 122, ΔV'" is smaller than ΔV".

Thus, it is understood from FIG. 11B that although the gate voltage Vg of the driving transistor 104 is (Vdata−Vth+ΔV'−ΔV"+ΔV'"), 2ΔV'>(ΔV'−ΔV"+ΔV'"). This means that influence of kickback is reduced according to the third embodiment.

In accordance with embodiments, influence of kickback generated at a gate of the driving transistor 104 may be reduced or eliminated by using a parasitic capacity 122 of the current light-emitting element 118. Thus, display unevenness of an electro-optic device 10 is improved by reducing a variation in a driving voltage of the driving transistor 104 included in the pixel circuit 100.

Fifth Embodiment

A fifth embodiment is directed to reducing influence of kickback by setting a voltage level of a second gate signal line 22 to a third level in a pixel circuit 100 shown in FIG. 2. A pixel circuit 100 according to a fifth embodiment is substantially the same as that shown in FIG. 2, and a description thereof is thus omitted.

Figure 12:
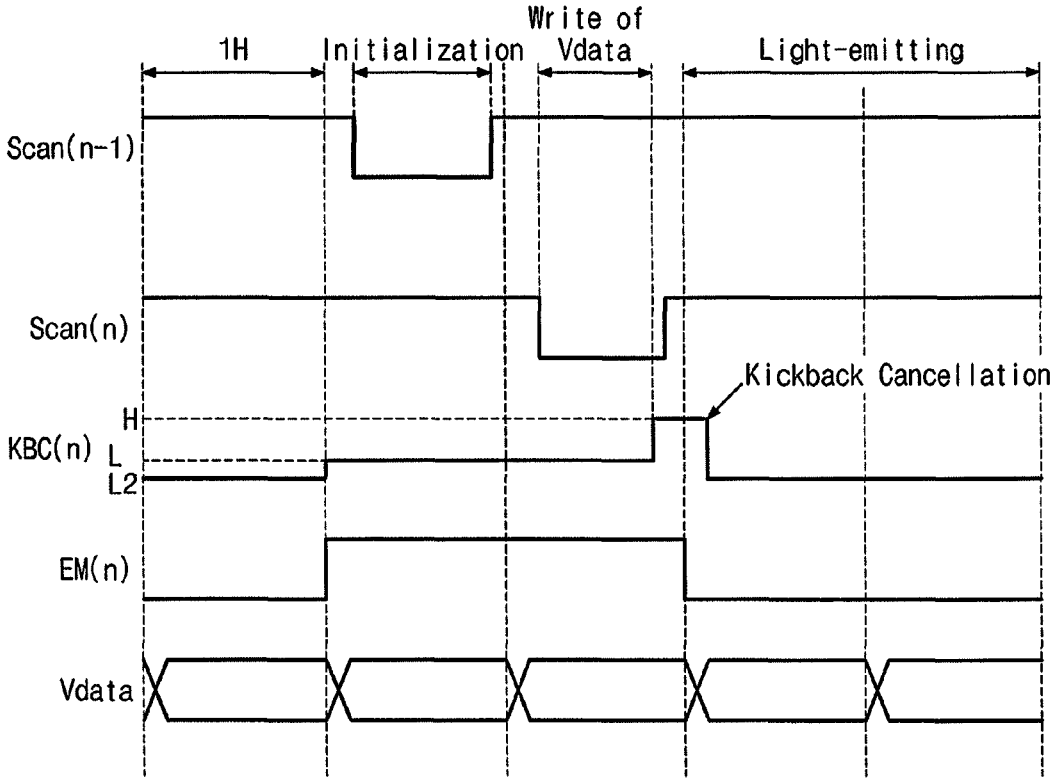
FIG. 12 illustrates a timing diagram for describing an operation of the pixel circuit of FIG. 2 according to a fifth embodiment.

FIG. 12 illustrates a timing diagram for describing an operation of a pixel circuit 100 according to a fifth embodiment. A timing diagram of FIG. 12 shows signals Scan(n), KBC(n), and Scan(n−1) of first to third gate signal lines 20 to 24, and a signal EM(n) of a light-emitting control line 26 with respect to an initialization period, a data write period, and a light-emitting period.

During the data write period, the signal Scan(n) provided to the first gate signal line 20 transitions from a high level to a low level, the signal KBC(n) provided to the second gate signal line 22 goes to a first low level (L), and the signal Scan(n−1) provided to the third gate signal line 24 goes to a high level. At this time, a transistor 102 is turned on by the signal Scan(n) of the first gate signal line 20, and a data signal is provided from a data signal line 28 to the driving transistor 104. Also, since the first transistor 112 is turned on and the second transistor 114 is turned on by the signal KBC(n) of the second gate signal line 22, the driving transistor 104 is diode connected. Thus, a voltage level of the data signal is provided to a gate of the driving transistor 104 through the first and second transistors 112 and 114.

When the data write period is ended, to hold a gate voltage by blocking a conduction state between a gate and a drain of the transistor 104, the signal KBC(n) provided to the second gate signal line 22 first transitions from a low level to a high level, and then the signal Scan(n) provided to the first gate signal line 20 transitions from a low level to a high level. The second transistor 114 proximate to the gate of the driving transistor 104 is first turned off, and the first transistor 112 is then turned off. That is, the first and second transistors 112 and 114 are not turned off at the same time.

The signal KBC(n) provided to the second gate signal line 22 is a signal that transitions from a high level to a second low level (L2) at a following period (e.g., at the light-emitting period), and makes the second transistor 114 turned on. Here, the second low level (L2) is lower than the first low level (L). As compared with the case that the signal KBC(n) is set to the first low level (L), a voltage between a gate and a drain of the second transistor 114 is increased by setting a gate voltage of the second transistor 114 proximate to a gate of the driving transistor 104 to a lower voltage. Thus, influence of kickback is cancelled. A gate signal line driving circuit 12 may comprise a shift register that shifts a voltage level of the signal KBC(n) provided to the second gate signal line 22 into three levels: a high level H, a first low level L, and a second low level L2. This will be more fully described with reference to FIGS. 13*a* to 13C.

Figure 13A:
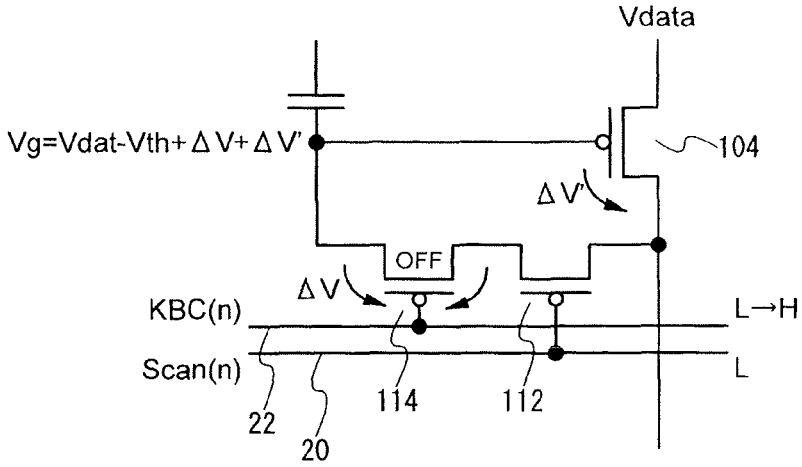
FIG. 13A to 13C illustrate circuit diagrams for describing an operation of the pixel circuit of FIG. 2 according to a fifth embodiment.

As illustrated in FIG. 13A, if a second transistor 114 is first turned off at a data write period, a voltage ΔV due to kickback generated when the second transistor 114 is turned off is added to a gate voltage of a driving transistor 104, and a voltage ΔV' due to kickback generated between a gate and a drain of the driving transistor 104 is further added to the gate voltage Vg of the driving transistor 104.

Figure 13B:
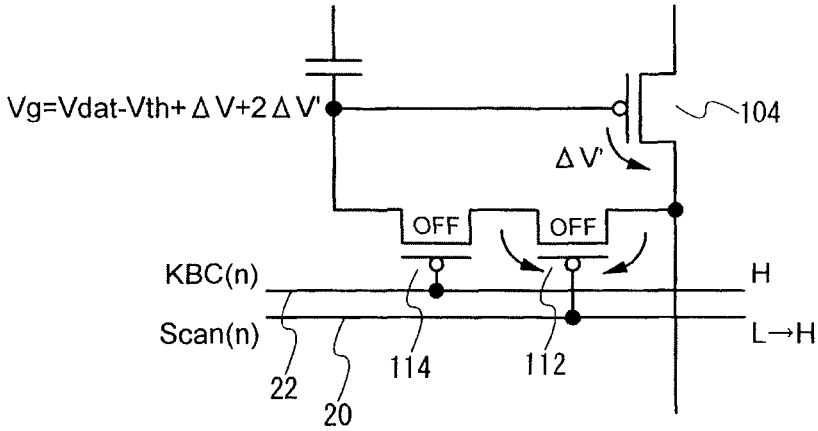

As shown in FIG. 13B, influence of kickback generated when a first transistor 112 is turned off enables a gate voltage to be increased through a parasitic capacitance Cgd of a drain side of the driving transistor 104. Thus, the gate voltage Vg of the driving transistor 104 becomes (Vg=Vdata−Vth+ΔV+2ΔV').

Figure 13C:
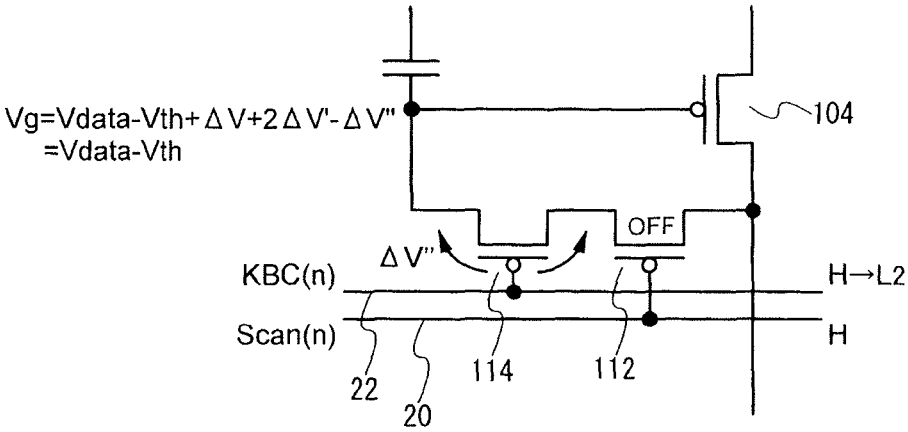

As illustrated in FIG. 13C, a voltage ΔV" due to kickback generated when the second transistor 114 is turned on is suppressed by setting a voltage of a signal KBC(n) of a second gate signal line 22 to a predetermined value when the second transistor 114 is turned on. That is, the gate voltage Vg of the driving transistor 104 is set to (Vdata−Vth) by setting a voltage of the signal KBC(n) to L2 such that a voltage ΔV" due to kickback becomes (ΔV+2ΔV').

In accordance with embodiments, influence at a drain side of a driving transistor may be reduced or cancelled by setting a voltage level of a gate signal line of a transistor connected to a gate side of the driving transistor, to a third level.

By way of summation and review, and without intending to be bound by theory, embodiments are directed to reducing or eliminating kickback that is generated by two factors. One being influence due to a parasitic capacity between a gate and a drain of a transistor. Two being a discharge of channel charges at an on-to-off transition of the transistor. In a transistor circuit, the two factors are based on redistribution of charges generated when the transistor is turned on and off.

With the electro-optic device and driving method thereof according to embodiments, a variation in a voltage due to kickback may be prevented or reduced by compensating a threshold voltage of the driving transistor and holding a voltage using a capacity element connected to a gate of the driving transistor such that a voltage of the compensated data signal is held as a gate voltage.

With the electro-optic device and driving method thereof according to embodiments, a leak current may be prevented or reduced by connecting the third transistor between the first transistor and the second transistor and turning off the third transistor at the same time with the first transistor. A variation in a data voltage written at a gate of the driving transistor is prevented or reduced.

With the electro-optic device and driving method thereof according to embodiments, influence of kickback may be prevented or reduced by a parasitic capacity of a current light-emitting element by turning on the light-emitting control transistor such that a drain of the driving transistor and the current light-emitting element are connected.

With the electro-optic device and driving method thereof according to embodiments, influence of kickback may be prevented or reduced by setting a gate voltage of a second transistor, proximate to a gate of the driving transistor, from among a plurality of transistors used for diode connection between a drain and a gate of the driving transistor.

With the electro-optic device and driving method thereof according to embodiments, influence of kickback may be prevented or reduced by installing a second capacity element in parallel with a drain of the driving transistor.

In accordance with embodiments, display quality may be improved by suppressing influence of kickback when a data signal of a voltage level according to a gradation is written at a driving transistor. Thus, display unevenness of an electro-optic device is improved by reducing a variation in a driving voltage of the driving transistor included in the pixel circuit.

In accordance with embodiments, variation in a voltage due to kickback may be prevented or reduced by compensating a threshold voltage of the driving transistor and holding a voltage using a capacity element connected to a gate of the driving transistor such that a voltage of the compensated data signal is held as a gate voltage.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A driving method of an electro-optic device comprising:

initializing a gate voltage of a driving transistor;

performing a data write operation where, when a data signal having a voltage level corresponding to a gradation is provided to the driving transistor, a threshold voltage of the driving transistor is compensated by turning on a first transistor and a second transistor connected in series between a drain and a gate of the driving transistor and a voltage is provided to a capacity element connected to the gate of the driving transistor to hold a voltage of the compensated data signal as a gate voltage, the first transistor being placed at a drain side of the driving transistor and the second transistor being placed at a gate side of the driving transistor; and performing a light-emitting operation by providing a drain current according to the held gate voltage of the driving transistor to a light-emitting element connected to the drain of the driving transistor, wherein, when the data write operation is ended, the second transistor of the first and second transistors being at a turn-on state is first turned off and, then, the first transistor is turned off; and wherein the second transistor is again turned on after the first transistor is turned off.

2. The driving method as claimed in claim 1, wherein the data signal is provided to a source of the driving transistor.

3. The driving method as claimed in claim 2, wherein the first transistor and at least one third transistor connected in series between the first transistor and the second transistor is at a turn-on state during the data write operation and is at a turn-off state during the light-emitting operation.

4. The driving method as claimed in claim 2, wherein the first transistor and the at least one third transistor connected are turned off at a same time during the light-emitting operation.

5. The driving method as claimed in claim 1, wherein, when the data write operation is ended:

the second transistor of the first and second transistors being at a turn-on state is first turned off, then a light-emitting control transistor connected between the drain of the driving transistor and the current light-emitting element is turned on, then the first transistor is turned off, and after the first transistor is turned off, the second transistor is again turned on.

6. The driving method as claimed in claim 1, wherein a voltage is provided to a gate of the second transistor such that a gate-drain voltage when the second transistor is turned on at the light-emitting operation is higher than a gate-drain voltage when the second transistor is turned on at the data write operation.

7. An electro-optic device comprising:

pixel circuits arranged in a matrix, data signal lines configured to transfer data signals having voltage levels corresponding to a gradation to the pixel circuits; and first and second gate signal lines configured to control the pixel circuits, wherein each pixel circuit comprises:

a driving transistor configured to provide the data signal line with a voltage corresponding to the data signal;

a current light-emitting element connected to a drain of the driving transistor and supplied with a current according to a gate voltage of the driving transistor;

a reset transistor configured to reset a voltage of a gate of the driving transistor;

first and second transistors connected in series such that the drain and the gate of the driving transistor are diode connected, the first transistor being placed at a drain side of the driving transistor and the second transistor being placed at a gate side of the driving transistor; and a capacity element configured to hold a voltage provided to the gate of the driving transistor, wherein a gate of the first transistor is connected to the first gate signal line and a gate of the second transistor is connected to the second gate signal line, wherein, during a data write period, a threshold voltage of the driving transistor according to the data signal is compensated and a voltage is provided to the capacity element to hold a data signal compensated as a gate voltage of the driving transistor, signals for turning on the first transistor and the second transistor are provided to the first gate signal line and the second gate signal line, respectively;

wherein when the data write period is ended, a signal for turning off the second transistor is first provided to the second gate signal line, and afterwards a signal for turning off the first transistor is provided to the first gate signal line; and wherein, after the first transistor is turned off, a signal for again turning on the second transistor is provided to the second gate signal line.

8. The electro-optic device as claimed in claim 7, wherein each pixel circuit further comprises a second capacity element connected to the drain of the driving transistor.

* * * * *